US008166733B2

(12) United States Patent
Abell

(10) Patent No.: US 8,166,733 B2
(45) Date of Patent: May 1, 2012

(54) METHOD FOR MAKING TAMPER EVIDENT CARD CARRIER

(75) Inventor: David Garland Abell, Delaplane, VA (US)

(73) Assignee: Oberthur Technologies of America Corp., Chantilly, VA (US)

( * ) Notice: Subject to any disclaimer, the term of this patent is extended or adjusted under 35 U.S.C. 154(b) by 0 days.

(21) Appl. No.: 13/166,956

(22) Filed: Jun. 23, 2011

(65) Prior Publication Data

US 2011/0251037 A1 Oct. 13, 2011

Related U.S. Application Data

(62) Division of application No. 12/714,912, filed on Mar. 1, 2010, now Pat. No. 7,987,989.

(60) Provisional application No. 61/157,222, filed on Mar. 4, 2009.

(51) Int. Cl.
*B31B 21/00* (2006.01)

(52) U.S. Cl. ..... 53/452; 53/133.1; 493/222

(58) Field of Classification Search ..... 53/452, 53/133.1; 493/222
See application file for complete search history.

(56) References Cited

U.S. PATENT DOCUMENTS

| | | | | |
|---|---|---|---|---|
| 3,252,234 | A * | 5/1966 | Goodman | 40/638 |
| 4,173,922 | A * | 11/1979 | Helm | 493/229 |
| 5,439,255 | A * | 8/1995 | McIntire et al. | 283/62 |
| 5,635,012 | A * | 6/1997 | Belluci et al. | 156/277 |
| 6,173,833 | B1 * | 1/2001 | Strehlow | 206/216 |
| 2002/0084649 | A1 * | 7/2002 | Casagrande | 283/98 |
| 2009/0188970 | A1 * | 7/2009 | Gouelibo et al. | 235/375 |

* cited by examiner

*Primary Examiner* — Hemant M Desai
(74) *Attorney, Agent, or Firm* — Law Offices of Peter H. Priest, PLLC

(57) ABSTRACT

Techniques for providing cost effective and tamper evident prepaid card packaging are described. By forming a cutout in a panel of the prepaid card packaging, covering the cutout with a material such as red glassine, and aligning an activation bar code or other indicia on the card with the cutout when mounting the card within the packaging, the security of the activation indicia can be better maintained. After purchase, the bar code can be scanned through the red glassine but prior to purchase, the red glassine prevents photocopying.

7 Claims, 6 Drawing Sheets

METHOD FOR MAKING TAMPER EVIDENT CARD CARRIER

This application is Divisional Application of U.S. application Ser. No. 12/714,912 filed on Mar. 1, 2010 now U.S. Pat. No. 7,987,989 issued on Aug. 2, 2011, which claims benefit of U.S. Provisional Application No. 61/157,222, filed on Mar. 4, 2009.

FIELD OF INVENTION

The present invention relates generally to improvements in prepaid card packaging and activation, and more particularly to advantageous aspects of packaging of prepaid cards in a tamper evident manner to reduce fraud.

BACKGROUND OF THE INVENTION

As prepaid cards have become more and more prevalent, techniques for cost effectively packaging such cards in a tamper evident manner are highly desirable. While a wide variety of previous approaches have been tried, many such approaches have failed to provide the right balance of features. For example, a highly secure package may be too hard to open by a legitimate customer after purchase, too expensive or both. A very cost effective package may be too susceptible to fraud.

Additionally, according to one aspect of many prepaid card systems, a bar code is scanned utilizing a bar code scanner at the time of sale of the card as part of the activation process for the card. Where the bar code is externally on the card packaging it is publicly accessible and potentially subject to attack. Similarly in another prepaid card system, the bar code is on the card and is visible through an aperture in the card packaging as shown and described in U.S. Pat. No. 5,777,305, for example. In such an approach, the bar code is again publicly visible and accessible and is potentially subject to fraud attempts.

SUMMARY OF THE INVENTION

To such ends, as well as to address other issues addressed further below, one aspect of the present invention addresses a card package which may suitably comprise bi-panel having a fold line with a first panel to one side of the fold line and a second panel to the other side of the fold line, the first panel having an area which may suitably be employed to support a product literature insert on an inside face, and the second panel having an area reserved for a card located within a no glue region on an inside face; and a glue area between the no glue area and the edges of the second panel. The card has a magnetic stripe and a bar code or other indicia on the back surface which faces the second panel. Alternatively, two separate panels may be pressed together to form the package.

As discussed in greater detail below, the second panel advantageously employs a cutout covered with red glassine. The cutout aligns with an activation bar code on the gift card and prevents photocopying of that bar code as the red glassine photocopies as solid black on a standard black and white copier and as solid red on a color photocopier. Thus, one intent on fraud is blocked from photocopying the activation bar code on one package and then applying it to a second package. The activation bar code can still be scanned by a typical checkout bar code scanner as part of the activation process as the red glassine passes infrared from the scanner.

A more complete understanding of the present invention, as well as other features and advantages of the invention, will be apparent from the following detailed description, the accompanying drawings, and the claims.

DETAILED DESCRIPTION

Figure 1:
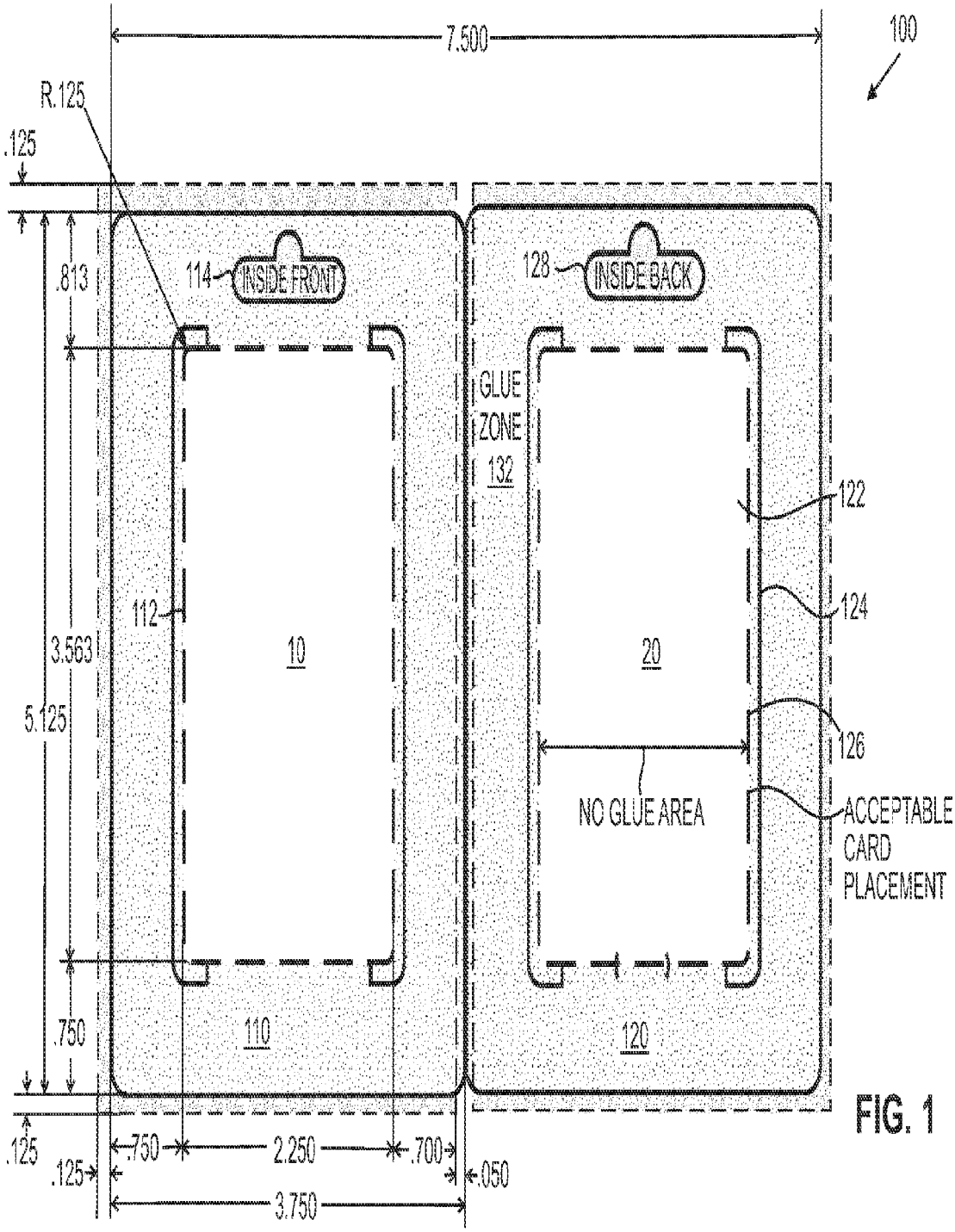
FIG. 1 shows an open card carrier blank supporting a terms and conditions booklet and gift card which when glued shut forms a gift card carrier in accordance with a first embodiment of the invention.

FIG. 1 shows a card carrier blank utilized to foam a gift card carrier 100 in accordance with a first embodiment of the present invention. More specifically, FIG. 1 shows a bi-panel arrangement in which a first panel 110 and a second panel 120 are folded about a centerline 130 and glued shut to form a gift card carrier as described in further detail below. Illustrative dimensions are included in FIG. 1 for the gift card carrier 100 for use with a gift card which is the size of a standard credit card. A presently preferred material for carrier 100 is 8 point or 12 point white paper having a nominal thickness of 0.0008" or 0.012", respectively. It will be recognized that other dimensions may be suitably employed for cards having other dimensions and that materials other than paper may be suitably employed.

First panel 110 has a rectangular area 112 where a terms and condition pamphlet or other product literature insert 10 may be suitably attached with fugitive glue, for example, which allows the pamphlet or insert to be readily removed by a customer that purchases the gift card upon opening the carrier 100. First panel 110 also includes a first smaller hangtag cutout 114.

Second panel 120 has a first rectangular area 122 where a gift card 20 is suitably attached with fugitive glue, for example, allowing the gift card to be readily detached from the carrier once a customer has purchased the gift card and opened the carrier 100. A second area 124 is a tolerance area within which the gift card may be acceptably mounted. In FIG. 1, card 20 is shown centered within the tolerance area 124. Second panel 120 also includes a second larger hangtag cutout 128.

In this embodiment, glue is adhered or otherwise applied around the edges of both panels 110 and 120. In one approach, the glue is applied, in a glue zone 132 which in one embodiment is everywhere except the glue free zones, with a glue applicator as part of the process of printing the card carrier with any text, such as the manufacturer's name or logo, the card company, name, logo and the like, or any other printed text, advertising materials and the like that are desired to be printed on the carrier 100.

Then, the gift card 20 is attached to the panel 120, and the pamphlet or product literature insert 10 is attached to panel 110. The panels are folded together about centerfold line 130 like a clamshell so that the cutouts 114 and 128 form a hangtag opening for hanging the gift card sealed in the carrier 100 for display. Where glue applied during printing is utilized, heat and pressure are applied to activate the glue and to seal the panels 110 and 120 together The seal formed is preferably at least 0.5" wide and even more preferably is approximately 0.625" wide which is the case when glue is applied everywhere except the glue free zones. In a second approach, after the booklet and card are attached, hot melt glue is applied to one or both of the panels 110 and 120 in a bead or in dots with a pressure gun applicator. Where hot melt glue is employed, the closed carrier is rolled between rollers as the glue cools and sets so that the glue is applied uniformly and a wide area seal is formed.

Figure 2:
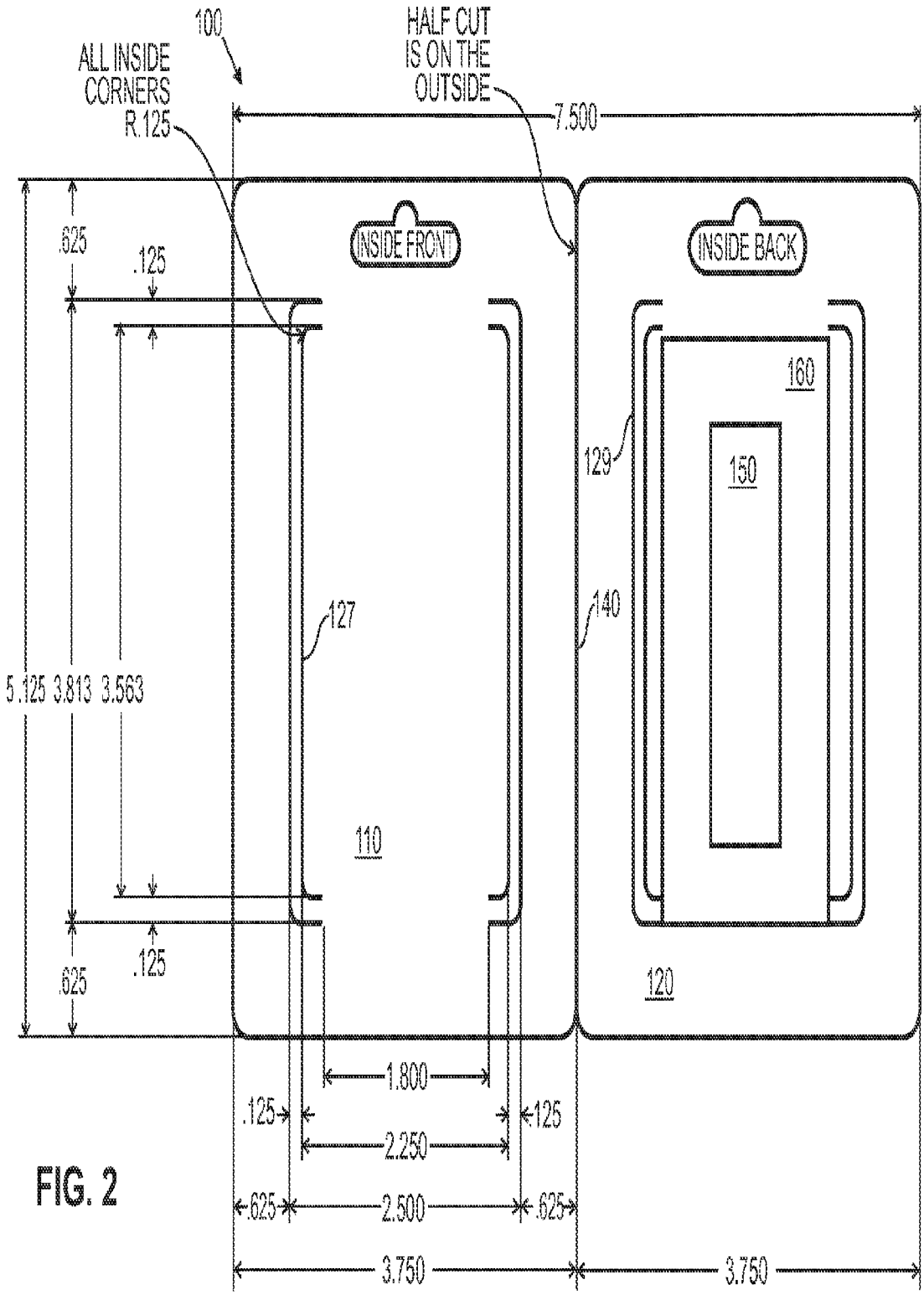
FIG. 2 shows inside details of the card carrier blank of FIG. 1 without the terms and conditions booklet and gift card.
Figure 3:
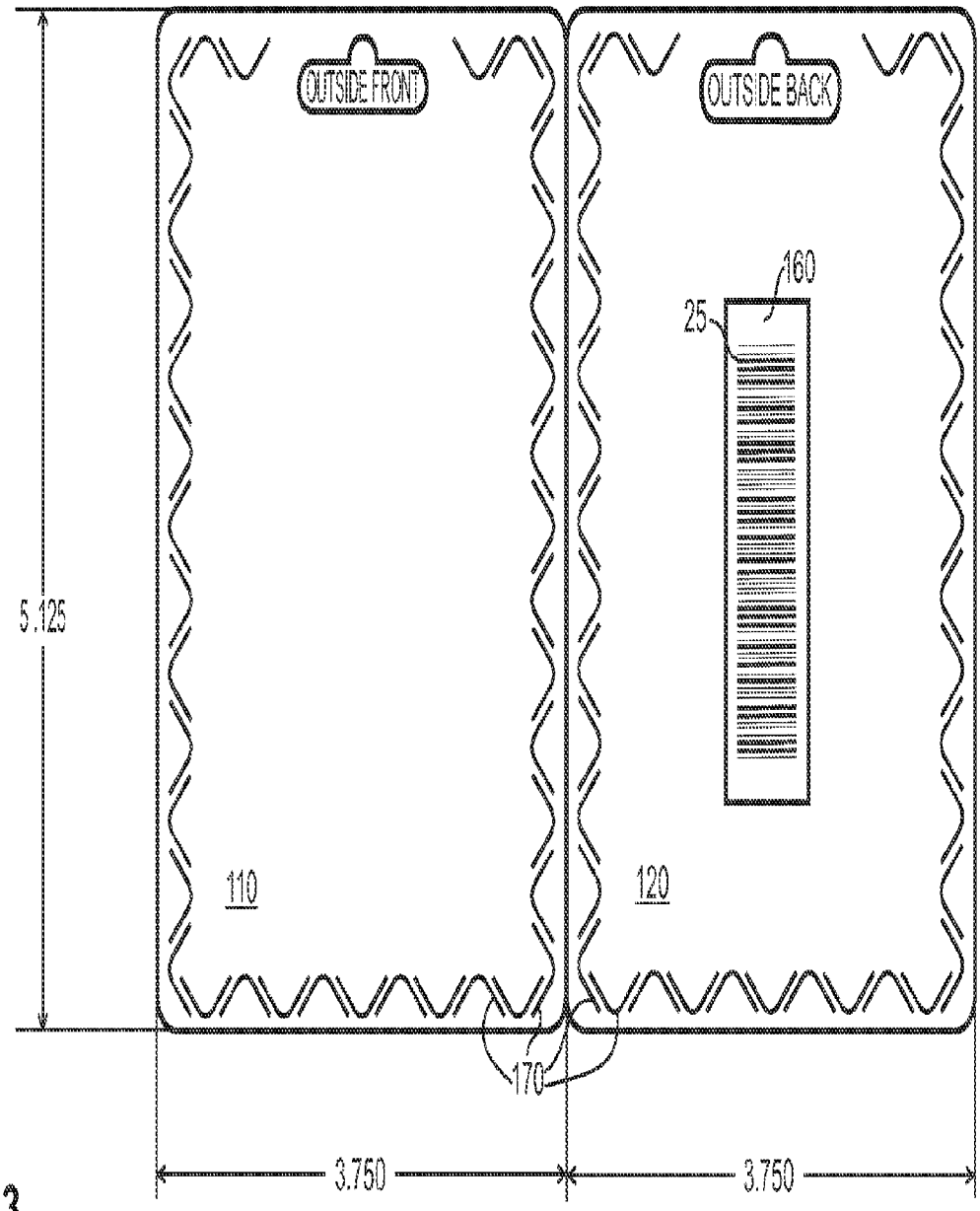
FIG. 3 shows outside details of the card carrier blank of FIGS. 1 and 2.

FIG. 2 shows the inside front and inside back of panels 110 and 120 of the card carrier blank without the terms and conditions pamphlet 10 and without the gift card 20. A half cut 140 is made on the outside of the card carrier blank to facilitate folding during manufacture of the gift card carrier 100. A cutout 150 is visible through a sheet of red glassine 160 which covers it. Lines 127 and 129 serve as alignment aids for the proper mounting of product literature insert 10 and card 20, respectively. FIG. 3 shows the outside back of panels 110 and 120 of the card carrier blank with card 20 attached on the inside of panel 120 and illustrates how a bar code 25 is visible to the human eye through the red glassine 160 in accordance with an embodiment of the present invention. As discussed further below the bar code 25 can be scanned by a bar code scanner during activation of the card, but cannot be photocopied by one intent upon committing fraud. Security cuts, such as cuts 170, can be added to further improve tamper evidence.

Figure 4:
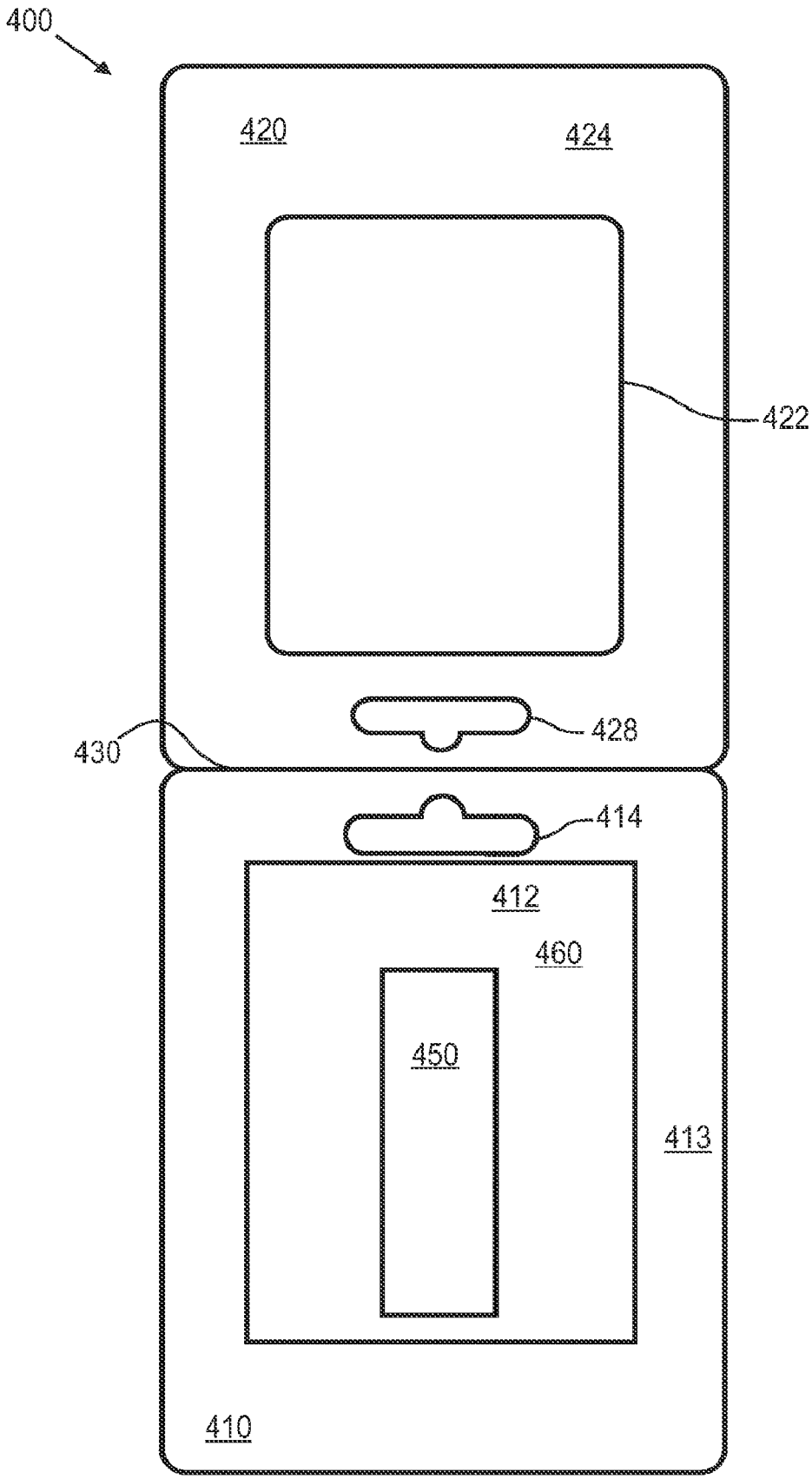
FIG. 4 shows an open card carrier blank utilized to form a gift card carrier in accordance with a second embodiment of the invention.

Aspects of a second embodiment of a card carrier in accordance with the present invention are illustrated in FIG. 4. In FIG. 4, a top fold tablet card carrier 400 is illustrated. Similar to the embodiment of FIG. 1, a first panel 410 includes a first area 412 reserved for a gift card. No card is shown in FIG. 4. First panel 410 also includes a first larger hangtag cutout 414. Additionally, the first panel 410 includes a cutout 450 which can be seen through red glassine sheet 460 which covers it.

Second panel 420 has a first area 422 reserved for attaching a terms and conditions pamphlet or other product literature insert. No product literature is shown in FIG. 4. A second area 424 defines a glue region. Second panel 420 also includes a second smaller hangtag cutout 428.

In this second embodiment, glue is applied around the edges of second panel 420 in either of the two ways described above in connection with FIG. 1. The red glassine sheet 460 is attached over cutout 450 then a gift card is attached to the panel 410. A terms and condition pamphlet or other product literature insert is attached to panel 420. Glue may be preapplied during printing as discussed above and the panels are then folded together about top fold line 430. The package is then sealed using a high pressure heat press that activates the glue as discussed above. Alternatively, as also discussed above, hot melt glue may be applied and then after folding the panels together, the card carrier is rolled under pressure rollers to seal the package with a wide seal area. Upon purchase of the card, a salesperson scans a bar code or other activation indicia on the card sealed within the gift card carrier 400 and the card is activated.

Figure 5:
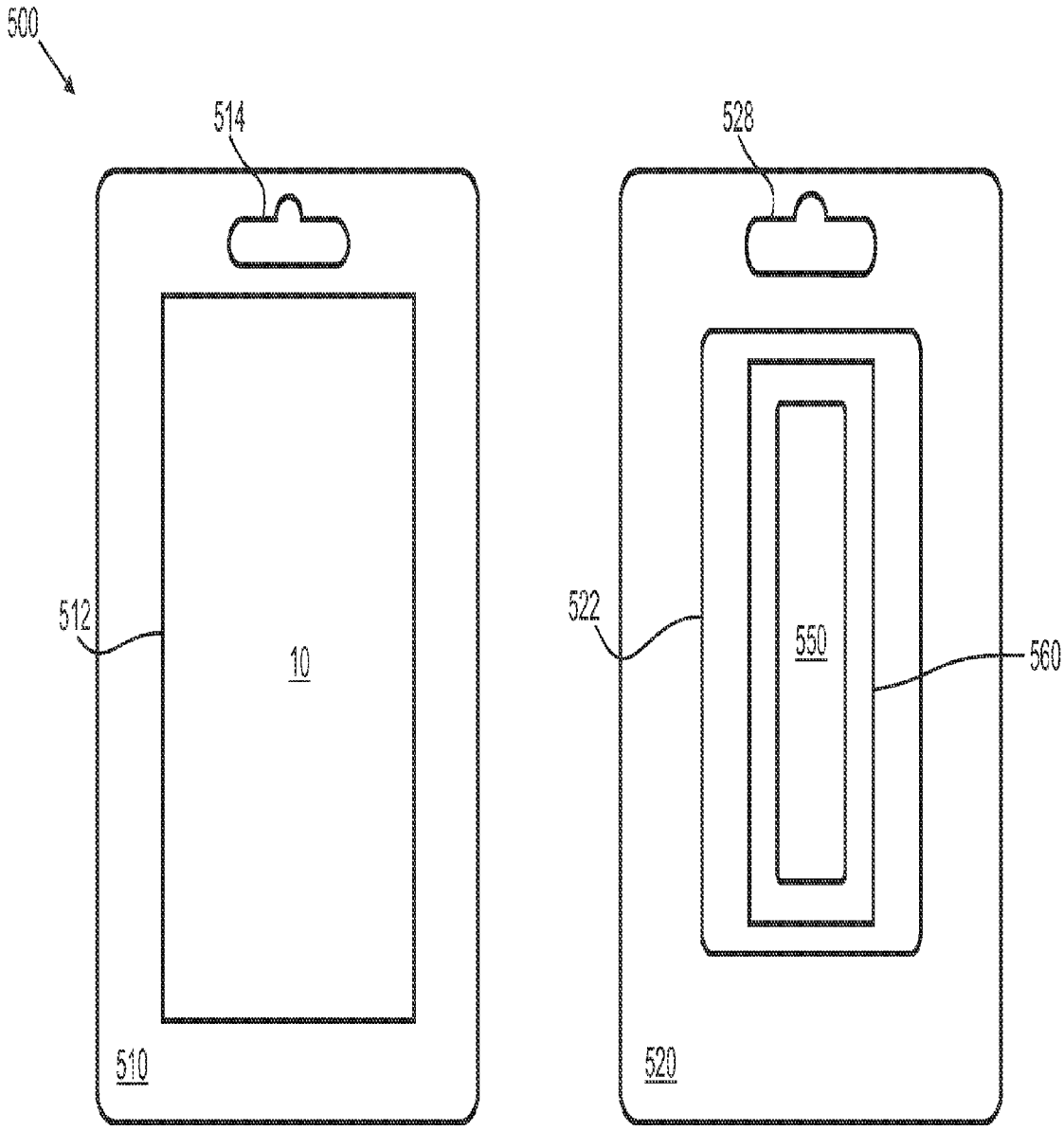
FIG. 5 shows a third embodiment of a card carrier in accordance with the present invention.

FIG. 5 shows a third embodiment of a card carrier 500 in accordance with the present invention. In FIG. 5, a first panel 510 of 12 point white paper and a separate second panel 520 of 12 point white paper are shown. For standard credit card sized gift cards, the dimensions of these two panels will preferably be the same as those shown for panels 110 and 120 in FIG. 1, respectively. Panel 510 has a first smaller hangtag cutout 514. Panel 520 has a second larger hangtag cutout 528.

As addressed above, it will be recognized that other thicknesses of paper may be employed in place of 12 point white paper and so long as the overall bottom thickness will be readable with a standard magstripe reader with an approximately 30 mil reader head spacing.

First panel 510 has a rectangular area 512 where a terms and conditions pamphlet or other product literature insert 10 may be suitably attached with fugitive glue, for example, which allows the booklet to be readily removed by a customer that purchases the gift card upon opening carrier 500. Second panel 520 has a cutout area 550 covered by red glassine 560, and an area 522 where gift card 20 is suitably attached with fugitive glue. In this third embodiment glue is adhered round the edges of either of the two panels 510 and 520. The two panels are aligned together and the glue is activated as discussed above.

Figure 6:
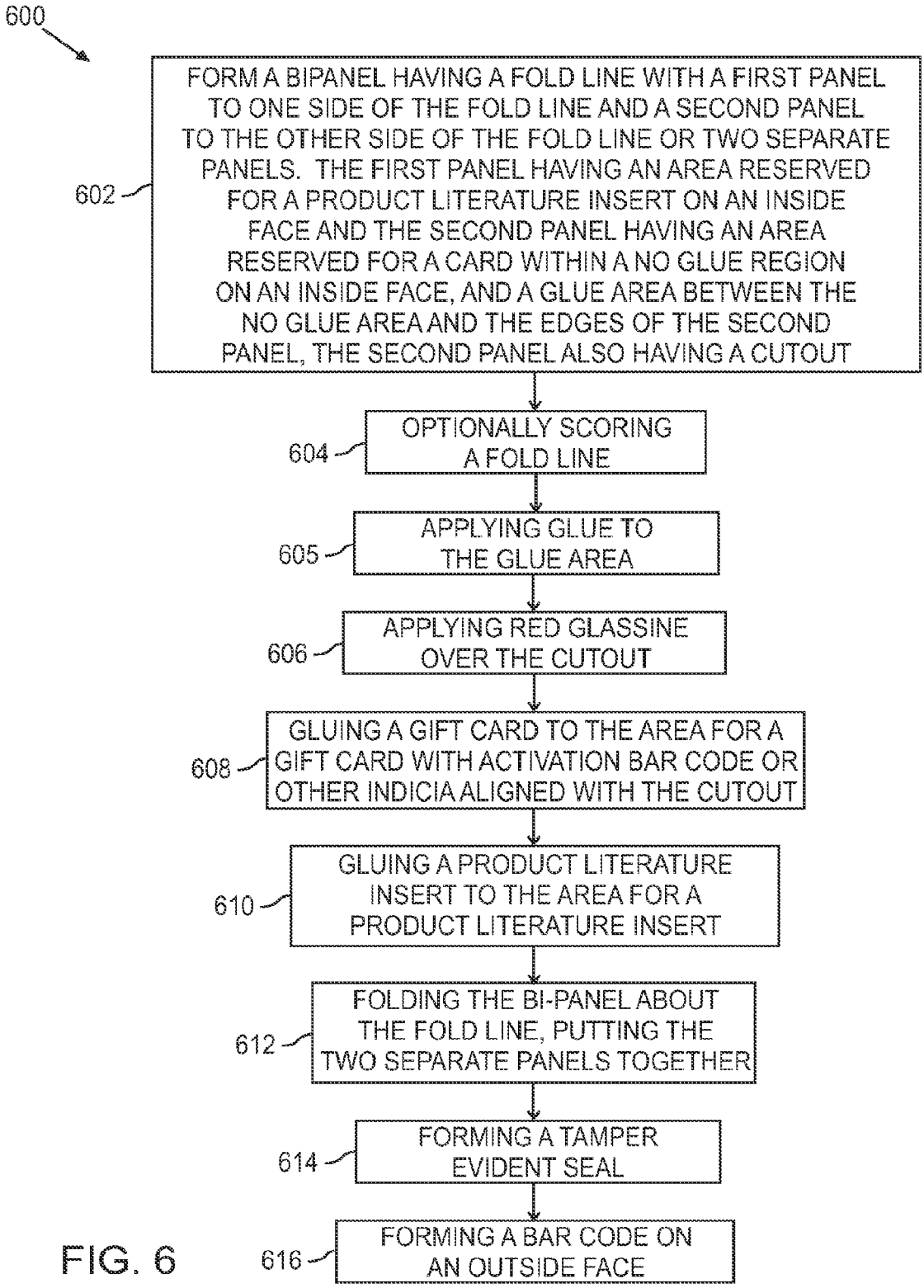
FIG. 6 shows a method of making a card carrier in accordance with the present invention.

FIG. 6 illustrates aspects of a method 600 of making a tamper evident card carrier in accordance with the present invention. In step 602, a bi-panel is formed having a fold line with a first panel to one side of the fold line and a second panel to the other side of the fold line, or alternatively two separate panels are formed. The first panel has an area reserved for a product literature insert on an inside face and the second panel has an area reserved for a card located within a no glue region on an inside face. While a single insert is discussed here as exemplary, it will be understood one or more inserts may be employed in a given application. A glue area between the no glue area and the edges of the second panel is also established. The second panel also has a cutout, such as the cutouts 150, 450 and 550, for example.

In step 604, the fold line is optionally scored for the bi-fold approach. In step 505, glue is applied to the glue area. In step 606, red glassine is applied over the cutout.

In step 608, a gift card is glued to the area for the card with fugitive glue. The placement of the card aligns a barcode or other activation indicia on the card with the cutout. In step 610, a product literature insert is glued to the area for a product literature insert with fugitive glue.

In step 612, the bi-panel is folded about the fold line, or the two separate panels are put together. In step 614, the glue is activated to form a tamper evident seal which is preferably at least 0.5" wide.

In an optional step 616, a UPC bar code is fondled on an outside face of either the first or second panel.

After purchase, in accordance with an embodiment of the present invention, the prepaid gift card is activated by scanning the activation bar code by store personnel, such as a checkout clerk, using a bar code scanner. While the bar code cannot be photocopied as a result of the red glassine, infrared from a standard bar code scanner will still read it. The card activation information is communicated to a remote processing center. This communication may be encrypted. The card activation information is processed and the card is activated.

In systems and processes, such as those described in U.S. Pat. No. 5,777,305 which is incorporated by reference herein in its entirety, the bar code is publicly visible and can be readily photocopied. This photocopied bar code can be used in a number of fraud schemes which will not be detailed herein in the interest of not propagating them further. However, the approach of the present invention negates a number of fraud schemes used to attack such cards by providing a bar code activation indicia which can be readily scanned with a bar code scanner, but not readily photocopied.

While the present invention has been disclosed in the context of various aspects of presently preferred embodiments, it will be recognized that the invention may be suitably varied and applied to other environments consistent with the teachings above and the claims which follow. By way of example, while the present invention is described in connection with embodiments for standard credit card sized cards, it will be recognized that the present teachings may be adapted to other shapes and sizes of cards, such as key fob or key chain cards, smart cards, and the like. Further, while the present invention is described in connection with embodiments in which paper and red glassine are employed, it will be recognized that various other types of materials, such as plastics and the like, may be suitably employed so long as that material can be employed consistent with the teachings herein. Additionally, while presently preferred approaches to gluing panels together have been described, variations thereon will be readily adapted to the demands of a particular environment or context.

I claim:

1. A method for making a tamper evident card carrier comprising:

forming a bi-panel having a fold line with a first panel to one side of the fold line and a second panel to the other side of the fold line, the first panel having a cutout and an area reserved for a product literature insert on an inside face and the second panel having an area reserved for a card located within a region on an inside face;

establishing a glue area extending inward from the edges of the second panel; and covering the cutout with a material with optical properties which allow barcode scanning therethrough, but prevent photocopying therethrough.

2. The method of claim 1 further comprising:

scoring the fold line.

3. The method of claim 1 further comprising:

applying glue to the glue area and wherein the glue area is at least 0.5 inches wide.

4. The method of claim 1 further comprising:

gluing a gift card to the area for a card with fugitive glue; and gluing a product literature insert to the area for a product literature insert with fugitive glue.

5. The method of claim 4 further comprising:

applying glue to the glue area;

folding the bi-panel about the fold line; and activating the glue to form a tamper evident seal which is at least 0.5 inches wide.

6. The method of claim 1 further comprising:

aligning an activation indicia on a gift card with the cutout and mounting the gift card on the gift card carrier in the area reserved for the card.

7. The method of claim 1 wherein said material is red glassine.

* * * * *